US006124075A

United States Patent [19]

Ishihara et al.

[11] Patent Number: 6,124,075

[45] **Date of Patent: *Sep. 26, 2000**

[54] LASER ABLATIVE RECORDING MATERIAL

[75] Inventors: Makoto Ishihara; Tadashi Ito, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/998,039

[22] Filed: Dec. 23, 1997

[30] Foreign Application Priority Data

Dec. 26, 1996 [JP] Japan ..... 8-348974
Mar. 21, 1997 [JP] Japan ..... 9-067937

[51] Int. Cl.[7] ..... B41M 5/26

[52] U.S. Cl. ..... 430/270.18; 430/945; 430/200; 430/201; 503/227; 428/64.8; 428/913; 369/284; 369/288

[58] Field of Search ..... 430/945, 200, 430/201, 270.18; 503/227; 428/64.8, 913; 369/284, 288

[56] References Cited

U.S. PATENT DOCUMENTS

| | | | |
|---|---|---|---|
| 4,772,582 | 9/1988 | DeBoer | 430/201 |
| 4,853,367 | 8/1989 | Henzel et al. | 503/227 |
| 4,973,572 | 11/1990 | DeBoer | 430/200 |
| 5,190,849 | 3/1993 | Santoh et al. | 430/945 |
| 5,256,506 | 10/1993 | Ellis et al. | 430/201 |
| 5,273,857 | 12/1993 | Neumann et al. | 430/945 |
| 5,330,876 | 7/1994 | Kaszezuk et al. | 430/201 |
| 5,360,694 | 11/1994 | Thien et al. | 430/201 |
| 5,387,496 | 2/1995 | DeBoer | 430/201 |
| 5,401,618 | 3/1995 | Chapman et al. | 430/201 |
| 5,459,017 | 10/1995 | Topel, Jr. et al. | 430/945 |
| 5,468,591 | 11/1995 | Pearce et al. | 430/945 |
| 5,521,629 | 5/1996 | DeBoer et al. | 347/262 |
| 5,529,884 | 6/1996 | Tutt et al. | 430/201 |
| 5,574,493 | 11/1996 | Sanger et al. | 347/262 |
| 5,712,079 | 1/1998 | Robello et al. | 430/201 |
| 5,725,989 | 3/1998 | Chang et al. | 430/201 |

FOREIGN PATENT DOCUMENTS

| | | |
|---|---|---|
| 0698503 | 2/1996 | European Pat. Off. . |
| 7-041501 | 2/1995 | Japan . |

*Primary Examiner*—Martin Angebranndt
*Attorney, Agent, or Firm*—Sughrue, Mion, Zinn, Macpeak & Seas, PLLC

[57] ABSTRACT

The present application discloses a laser ablative recording material which has one or more image forming layers on a support, and one or more intermediate layers between said image forming layer and said support, wherein:

at least one layer from among the layers on the image forming layer side contains a substance having absorption in the laser wavelengths, which is selected from dihydroperimidine-squarilium dyes represented by the following general formula (1):

wherein $R_1$, $R_2$, $R_3$, $R_4$, $R_5$, $R_6$, $R_7$ and $R_8$ independently represent a hydrogen atom, a substituted or unsubstituted alkyl group, a substituted or unsubstituted cycloalkyl group, or a substituted or unsubstituted aryl group; and $R_1$ and $R_2$, $R_3$ and $R_4$, $R_5$ and $R_6$, $R_7$ and $R_8$, $R_2$ and $R_3$ and/or $R_6$ and $R_7$ may be taken together to form 5 to 6 membered rings. The laser ablative recording material of the present invention is characterized by a small Dmin, high optical resistance and high humidity/heat resistance.

18 Claims, No Drawings

LASER ABLATIVE RECORDING MATERIAL

BACKGROUND OF THE INVENTION

The present invention relates to a laser ablative recording material, and a laser ablative record of an image formed through imagewise heating of the laser ablative recording material.

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. No. 5,330,876, U.S. Pat. No. 5,401,618 and U.S. Pat. No. 5,459,017) disclose recording materials applicable in this method, and Japanese Unexamined Patent Publications Nos. 8-48,053 and 8-72,400 (corresponding to U.S. Pat. No. 5,521,629 and U.S. Pat. No. 5,574,493) disclose imaging apparatuses used in this method. Image recording based on the ablation method is accomplished by irradiating a laser from a dye layer side onto a recording material having a dye layer comprising an image dye, a material having absorption in the laser wavelength region (infrared-absorbing material) and a binder formed on a support. On the spot to which the laser beam has been irradiated, a sharp local change takes place in an image forming layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the image dye.

Usefulness of this dye ablation imaging method largely depends upon removal efficiency of the imaging dyes upon laser exposure. As a scale representing this efficiency, the minimum concentration value (Dmin) of the laser exposure portion is employed. A smaller value of Dmin is suggested to lead to a higher dye removing efficiency.

These conventional ablative materials are not however practically applicable because of a low efficiency of converting optical energy of a laser into heat or a high value of the aforesaid Dmin representing dye removing efficiency based on a laser.

Cyanine dye is mainly used as an infrared absorbing dye for the conventional ablative recording materials, as described in Japanese Unexamined Patent Publication No. H07-149,063, posing as a result a problem of low stability such as low optical resistance and low humidity/heat resistance of the cyanine dye.

An object of the present invention is therefore to provide a laser ablative recording material which has a high ability to convert optical energy of a laser into heat, thereby permitting reduction of Dmin. Another object of the invention is to provide a laser ablative recording material having high stability such as high optical resistance and high humidity/heat resistance. Other objects of the invention will be easily understood by a person skilled in the art from the entire description of the specification.

SUMMARY OF THE INVENTION

These objects of the invention are achieved by providing the present invention having the following contents.

The present invention provides a laser ablative recording material which has one or more image forming layers on a support, and one or more intermediate layers between said image forming layer and said support, wherein:

at least one layer from among the layers on the image forming layer side contains a substance having absorption in the laser wavelengths, which is selected from dihydroperimidine-squarilium dyes represented by the following general formula (1):

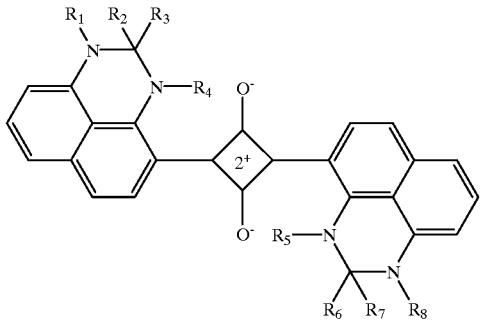

wherein $R_1$, $R_2$, $R_3$, $R_4$, $R_5$, $R_6$, $R_7$ and $R_8$ independently represent a hydrogen atom, a substituted or unsubstituted alkyl group, a substituted or unsubstituted cycloalkyl group, or a substituted or unsubstituted aryl group; and $R_1$ and $R_2$, $R_3$ and $R_4$, $R_5$ and $R_6$, $R_7$ and $R_8$, $R_2$ and $R_3$ and/or $R_6$ and $R_7$ may be taken together to form 5 to 6 membered rings.

A preferred embodiment of the invention is a laser ablative recording material in which a substance having absorption for laser wavelengths is contained in the intermediate layer. Another preferred embodiment of the invention is a laser ablative recording material in which a substance having absorption for laser wavelengths is contained in the intermediate layer provided between the support and the image forming layer. Still another preferred embodiment of the invention is a laser ablative recording material in which inorganic fine particles are contained in the image forming layer as an image forming substance. Still another preferred embodiment of the invention is a laser ablative recording material in which the inorganic fine particle is carbon black and/or colloidal silver.

Further, the present invention also provides a laser ablative image-formed record prepared by irradiating a laser to the aforesaid laser ablative recording material.

DETAILED DESCRIPTION OF THE PREFERRED EMBODIMENTS

Now, the configuration and the preferred embodiments of the laser ablative recording material and the image-formed laser ablative object will be described below in detail.

The laser ablative recording material has a configuration in which one or more layers including an image forming layer (hereinafter referred to as the "layers on the image forming layer side") is provided on one surface of the support, and one or more intermediate layers are provided between the support and the image forming layer. So far as such intermediate layer and image forming layer are provided on one surface of the support, there is no limitation on the layer configuration of the laser ablative recording material of the invention. An overcoat layer may therefore be provided on the image forming layer. Further, an undercoat layer for improving adhesion may be provided between the intermediate layer and the support. These image forming layer, intermediate layer, overcoat layer and undercoat layer may be single or multiple. One or more layers including a backcoat layer (hereinafter referred to as the "layers on the backcoat layer side") may be provided on the surface of the support opposite to the image forming layer.

The laser ablative recording material of the invention is characterized in that one or more layers on the image forming layer side contain a dihydroperimidinesquarilium dye represented by the general formula (1).

In the general formula (1), the alkyl group represented by $R_1$ to $R_8$ has 1 to 20 carbon atoms, preferably 1 to 12 carbon atoms (for example, methyl, ethyl, propyl, butyl, hexyl or undecyl). The alkyl group may be substituted with a halogen atom (F, Cl or Br), alkoxycarbonyl (for example, methoxycarbonyl or ethoxycarbonyl), hydroxy, alkoxy (for example, methoxy, ethoxy, phenoxy or isobutoxy) or acyloxy (for example, acetyloxy, butylcarbonyloxy, hexylcarbonyloxy or benzoyloxy). Examples of cycloalkyl group represented by $R_1$ to $R_8$ include cyclopentyl and cyclohexyl. The aryl group represented by $R_1$ to $R_8$ preferably have 6 to 12 carbon atoms, and may be for example phenyl or naphthyl. The aryl group may be substituted with an alkyl group having 1 to 8 carbon atoms (for example, methyl, ethyl or butyl), an alkoxy group having 1 to 5 carbon atoms (for example, methoxy or ethoxy), an aryloxy group (for example, phenoxy or p-chlorophenoxy), a halogen atom (F, Cl or Br), an alkoxycarbonyl (for example, methoxycarbonyl or ethoxycarbonyl), a cyano group, a nitro group or a carboxyl group.

$R_1$ and $R_2$, $R_3$ and $R_4$, $R_5$ and $R_6$, $R_7$ and $R_8$, $R_2$ and $R_3$ and/or $R_6$ and $R_7$ may be taken together to form 5 or 6 membered rings. Applicable 5 or 6 membered rings include substituted or unsubstituted cyclopentane ring, and substituted or unsubstituted cyclohexane ring. Substituents for these rings include the above-listed alkyl group, alkoxy group, aryloxy group, halogen atom, alkoxycarbonyl group, cyano group, nitro group, acyloxy group and hydroxy group.

In the present invention, applicable dihydroperimidinesquarilium dyes represented by the general formula (1) include, for example, a dihydroperimidinesquarilium dyes in which $R_1$, $R_4$, $R_5$ and $R_6$ are hydrogen atoms, dihydroperimidinesquarilium dyes in which $R_2$=$R_6$ and $R_3$=$R_7$, dihydrodinesquarilium dyes in which $R_2$, $R_3$, $R_6$ and $R_7$ are substituted or unsubstituted alkyl group or substituted or unsubstituted aryl groups, dihydroperimidinesquarilium dyes in which $R_2$ and $R_3$ and $R_6$ and $R_7$ are taken together to form 5 or 6 membered rings, and dihydroperimidinesquarilium dyes having a symmetric structure. The dihydroperimidinesquarilium dyes in which $R_1$, $R_4$, $R_5$ and $R_6$ are hydrogen atoms are preferably in the invention.

More specifically, examples of hydroperimidinesquarilium dye represented by the general formula (1) are as follows:

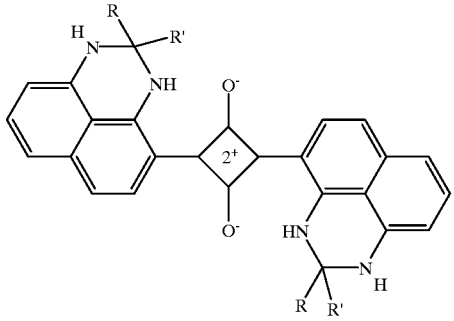

| No. | R | R' |
|---|---|---|
| 1 | $-CH_3$ | $-(n)C_{11}H_{23}$ |
| 2 | $-C_2H_5$ | $-C_{13}H_{27}$ |
| 3 | $-CH_3$ | —Ph |
| 4 | $-C_4H_9$ | $-C_4H_9$ |
| 5 | $-C_5H_{11}$ | $-C_5H_{11}$ |
| 6 | R and R' are taken together to form | 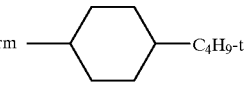 $-C_4H_9$-t |
| 7 | $-CH_2OCOC_5H_{11}$ | $-CH_2OCOC_5H_{11}$ |

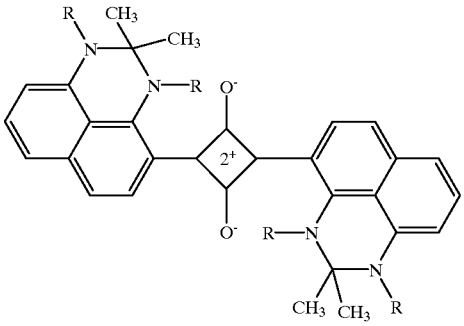

| No. | R |
|---|---|
| 8 | $-CH_3$ |
| 9 | $-C_3H_7$ |

A laser beam is absorbed in the image forming layer, and is converted into heat by a molecular process known as the internal conversion. The substance having absorption in the laser wavelengths as represented by the foregoing general formula (1) is used for this conversion into heat. The substance represented by the general formula (1) may be used alone or in combination with a known infrared absorbing substance such as carbon black, cyanine infrared-absorbing dyes disclosed in U.S. Pat. No. 4,973,572 or any of the infrared absorbing substances disclosed in U.S. Pat. Nos. 4,948,777, 4,950,640, 4,950,639, 4,948,776, 4,948,778, 4,942,141, 4,952,552, 5,036,040, 4,912,083, 5,360,694 and 5,380,635. These references are hereby incorporated by reference.

The aforesaid substance having absorption in the laser wavelengths may be contained in any of the layers on the image forming layer side, preferably in the intermediate layer provided between the image forming layer and the support. The substance having absorption in the laser wavelengths is used in an amount to provide an absorbance of laser wavelengths of from 0.5 to 6.0, more preferably from 1.0 to 5.0, further more preferably from 1.5 to 4.0.

There is no particular limitation on the image forming substance used for the image forming layer in the invention. For example, the ablative dyes disclosed in Japanese Unexamined Patent Publications Nos. 7-149,065, 7-149,066 and 8-104,065, and U.S. Pat. Nos. 4,541,830, 4,698,651, 4,695,287, 4,701,439, 4,757,046, 4,743,582, 4,769,360 and 4,753,922, which are hereby incorporated by reference, can be used in the invention.

A preferable image forming substance in the invention is an inorganic fine particle. Applicable inorganic fine particles include carbon black, graphite, colloidal silver, silver sulfide colloid and metal oxides. The color after coating inorganic fine particles used in the invention should have absorption within the UV-region in the case of image forming for printing and plate-making purposes, and should be black for medical uses. The particle size which gives a color of the inorganic particulate, which largely varies with circumstances, should preferably be within a range of from 5 to 500 nm, more preferably from 5 to 250 nm.

Any manufacturing process of inorganic fine particles satisfying the foregoing particle size condition may be employed in the invention. For preparing a carbon black material, for example, any of the processes such as the channel method as disclosed in Donnel Voet, "Carbon Black" published by Marcel Dekker Inc. (1976), the thermal method and the furnace method are applicable.

The coating amount of the image forming substance such as the inorganic fine particles in the image forming layer may be to any extent so far as it gives a concentration of at least 2.5 (an absorption value within the UV-region for printing purposes, and an absorption value within the visual region for medical uses) in the laser non-irradiated portion, and also varies with the kind of the image forming substance used and the size. Coating of carbon black (primary particle size: 80 nm) in 0.5 g/m$^2$ provides a UV-concentration of 4.2 and a visual concentration of 3.8. Coating of colloidal silver (particle size: 20 nm) in 0.5 g/m$^2$ provides a UV-concentration of 3.5 and a visual concentration of 0.4.

A binder having a glass transition temperature of at least 50° C. is preferably used for the image forming layer or the intermediate layer in the invention. Applicable binders include water-soluble binders such as gelatine, casein, starch, hydroxyethyl cellulose, carboxymethyl cellulose, polyvinyl alcohol, polyacrylamide, ethylene-maleic anhydride copolymer, and nitric acid esters of carboxyalkyl cellulose, and water-insoluble binders such as cellulose nitrate, polyvinyl butyral, triacetyl cellulose, methyl acrylatebutadiene copolymer, acrylonitrile-butadiene copolymer, and polycarbonate and polyurethane as disclosed in Japanese Patent Publication No. 4-506,709. Particularly, cellulose nitrate or nitric acid ester of carboxylalkyl cellulose should preferably be employed for the intermediate layer. Use of cellulose nitrate or nitric acid ester of carboxyalkyl cellulose improves the ablation efficiency, permitting reduction of Dmin at the laser-irradiated portion described above. These binders may be used alone or in combination.

The coating amount of binder is preferably in general within a range of from 0.1 to 5 g/m$^2$.

A polymer binder other then the above listed binders may be added on the image forming layer side of the laser ablative recording material of the invention. Particularly preferable is a decomposable polymer having a polystyrene equivalent molecular weight of at least 100,000 as measured by size exclusion chromatography disclosed in the U.S. Pat. No. 5,330,876, which is hereby incorporated by reference. A decomposable binder as herein used means a binder which is readily pyrolyzed at a temperature available upon laser image forming, thus giving a gas and a volatile fragment in a sufficient amount, or a binder for which the decomposition temperature is considerably reduced in the presence of a slight amount of acid.

In the recording material of the invention, an overcoat layer may be provided for the purpose of imparting satisfactory scraping resistance, wear resistance and mat finish. Provision of the overcoat layer permits easy handling because of the slightest risk of discoloration of the formed image caused by finger prints or the like.

Beads may be contained in the overcoat layer. Particularly, polytetrafluoroethylene beads should preferably be contained. The particle size and the coating amount of polytetrafluoroethylene beads can be set within a range effective for achieving the intended object. In general, the particle size should preferably be within a range of from about 0.1 to about 20 $\mu$m, or more preferably, from about 0.1 to about 5 $\mu$m. The coating amount should be within a range of from about 0.005 to about 5.0 g/m$^2$, or more preferably, within a range of from about 0.05 to about 0.5 g/m$^2$. Polytetrafluoroethylene beads are not necessarily required to be in a spherical shape, but may be in any arbitrary shape.

As the binder of the overcoat layer containing beads, any arbitrary polymer may be used. More specifically, applicable polymers include cellulose derivatives such as cellulose nitrate, cellulose acetate hydrogen phthalate, cellulose acetate, cellulose acetate propionate, cellulose acetate butylate, cellulose triacetate, hydroxypropyl cellulose ether, ethyl cellulose ether; nitric ester of carboxyalkyl cellulose; polycarbonate; polyurethane; polyester; poly(vinyl acetate); poly (vinyl halide) such as poly(vinyl chloride) and poly (vinyl chloride) copolymers; poly(vinyl ether); maleic acid anhydride copolymer; polystyrene; poly(styrene-co-acrylonitrile); polysulfon; poly(phenylene oxide); poly (ethylene oxide); poly(vinylalcohol-co-acetal) such as polytvinyl acetal), poly(vinylacetal-co-butyral) and poly (vinylbenzal); and mixtures and copolymers thereof. The binder for the overcoat layer can be used in a coating amount within a range of from about 0.1 to about 5 g/m$^2$.

A compound decomposed by heating and generating carbon dioxide, nitrogen or water may be contained in at least one layer on the image formation layer side provided in the laser ablative recording material of the invention. Containing this compound is desirable because of the effective reduction of Dmin. The compound generating carbon dioxide, nitrogen or water through decomposition by heating should preferably be contained in the image formation layer, the intermediate layer between the support and the image formation layer, or the overcoat layer, and particularly in the image formation layer or the intermediate layer. The coating amount is not particularly limited so far as Dmin at the laser-irradiated portion is reduced, and should preferably be within a range of from 0.05 to 10 mmol per m$^2$ of support, or more preferably, within a range of from 0.1 to 7.5 mmol.

A compound generating carbon dioxide by heating is a compound which has a structure comprising a bonding portion expressed as —$CO_2$— in the molecule, of which this bonding is broken by heating, thus generating carbon dioxide. Applicable compounds include electron-attracting group substituted acetic acids, malonic acids, oxamides, propionic acids, β-halo-cinnamic acids, α,β-epoxycarbonic acids, electron-attracting group substituted benzoic acids, polyhydroxy benzoic acids, amino-benzoic acids and other carbonic acids of which carbonate is removed by heating, metal salts and ammonium salts of these carbonic acids, lactones, carbonic esters, carbamates, and carbonates.

A compound generating nitrogen by heating is a compound having, in a molecule, a nitrogen-nitrogen bonding portion generating nitrogen upon heating and decomposition. Examples of such a compound include diazonium salts, diazo compounds, azo compounds, azide compounds, triazenes, tetrazols and hydrazines.

A compound generating water by heating is a compound having dehydrable hydroxide groups in the molecule or a compound containing water of crystallization. Examples of such a compound include alcohols, hydroxycarbonic acids, amino acids, dicarbonic acids, dicarbonic monoamides and compounds containing water of crystallization.

As a compound generating a gas by heating and decomposition, one decomposed at a temperature of over 50° C. is useful. When preservability is taken into account, a compound decomposed at a temperature within a range of from 100 to 500° C. is preferable, and one decomposed at a temperature within a range of from 150 to 300° C. is more preferable. Decomposability of these compounds may be measured by the use of an accelerated calorimeter (ARC), a differential scanning calorimeter (DCS) or a differential thermal analysis (DTA). These compounds generating a gas by heating and decomposition should preferably be ones not having absorption in a visible region of over 400 nm.

Now, typical compounds generating carbon dioxide, nitrogen or water through decomposition upon heating are enumerated below. The compound applicable in the invention is not however limited to those listed below.

(1)

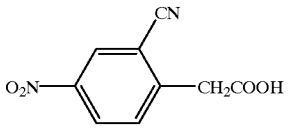

(2)

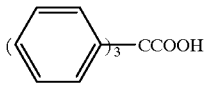

(3)

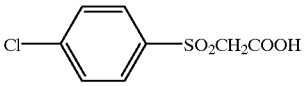

(4)

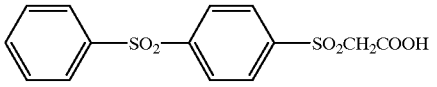

(5)

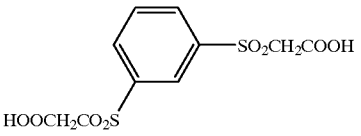

-continued (6)

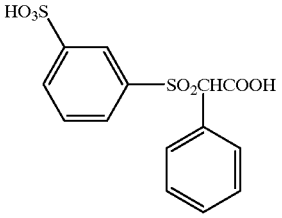

(7)

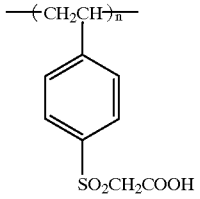

(8)

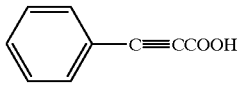

(9)

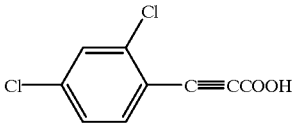

(10)

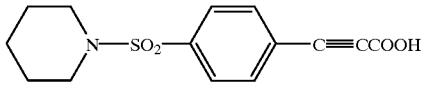

(11)

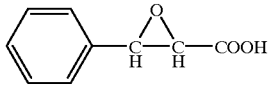

(12)

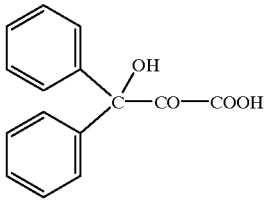

(13)

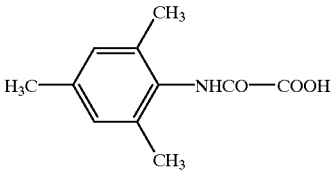

(14)

(15)

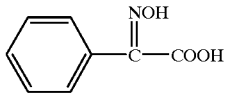

-continued
(16)
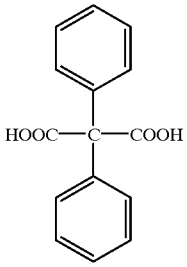
(17)
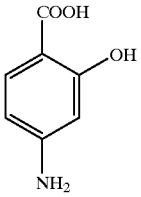
(18)
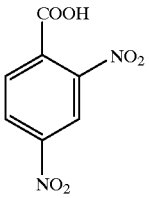
(19)
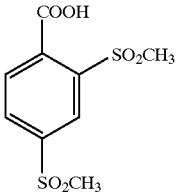
(20)
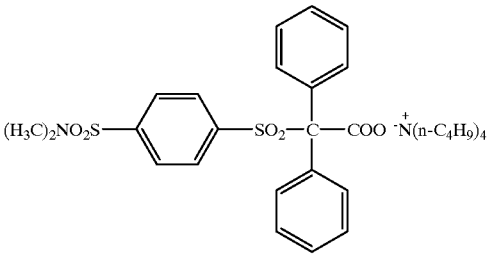
(21)
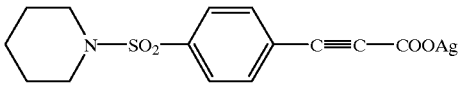
(22)
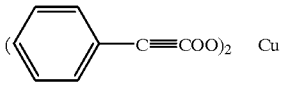
(23)
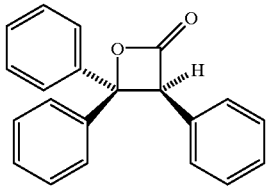
(24)
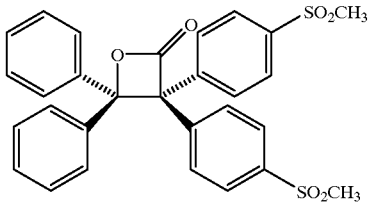
(25)
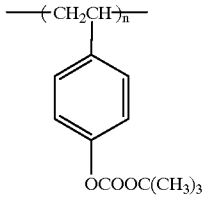
(26)
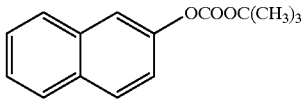
(27)
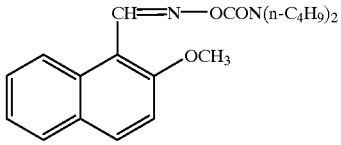
(28)
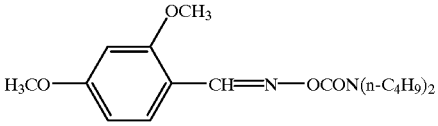
(29)
$NaHCO_3$
(30)
$K_2CO_3$
(31)
$(NH_4)_2CO_3$
(32)
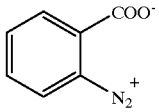
(33)
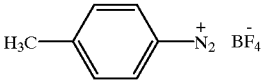

-continued
(34)
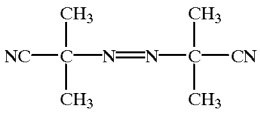
(35)
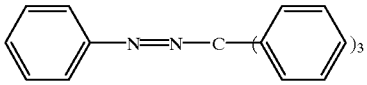
(36)
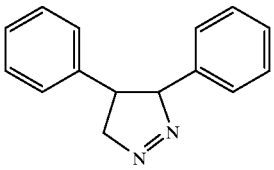
(37)
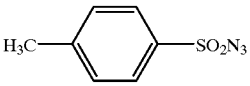
(38)
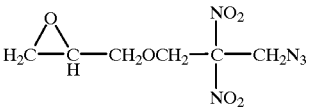
(39)
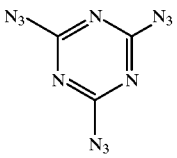
(40)
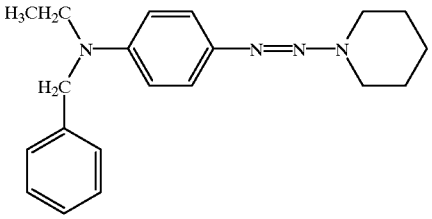
(41)
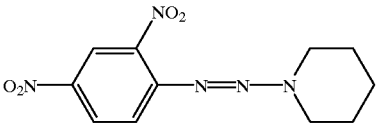
(42)
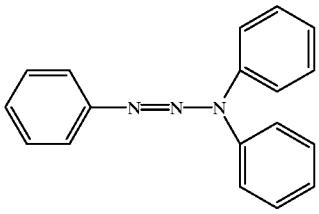
(43)
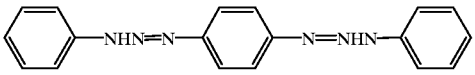
-continued
(44)
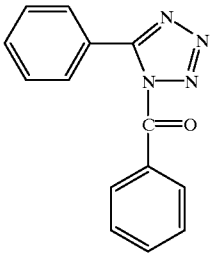
(45)
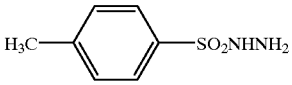
(46)
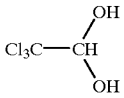
(47)
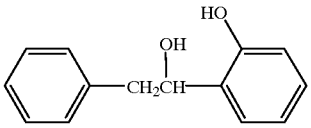
(48)
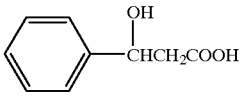
(49)
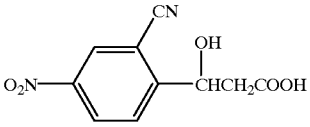
(50)
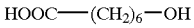
(51)
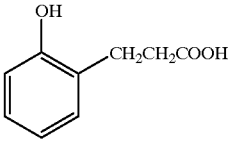
(52)
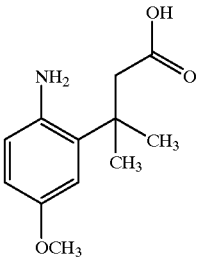
(53)
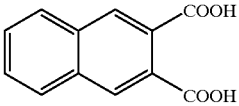

-continued (54)

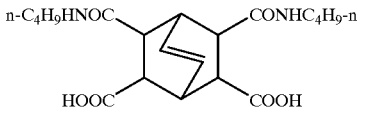

(55)

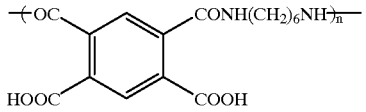

(56)

$CaCl_2 \cdot 6H_2O$ (57)

$MgCl_2 \cdot 6H_2O$ (58)

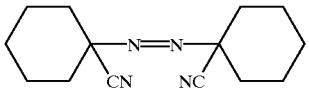

(59)

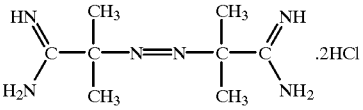

(60)

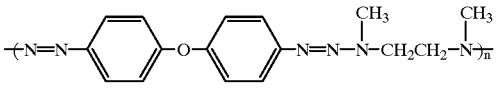

(61)

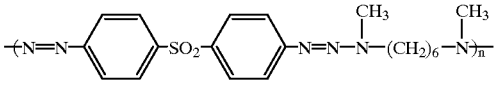

A backcoat layer may be provided in the laser ablative recording material of the invention. The backcoat layer may be formed on the surface of the support on the opposite side to the image formation layer.

From the point of view of adhesivity and strippability between recording materials, the outermost layer surface of the backcoat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the backcoat layer. In the invention, the matting agent should preferably have an average particle size of up to 20 $\mu$m, or more preferably, within a range of from 0.4 to 10 $\mu$m. The quantity of added matting agent should preferably be within a range of from 5 to 400 mg/m$^2$, or more preferably, from 10 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4, an alkali surface-modifying matting agent disclosed in Japanese Unexamined Patent Publication No. 4-127,142, page 3, right upper column, line 7 through page 5, right lower column, line 4, or an organic polymer matting agent disclosed in Japanese Patent Application No. 4-265,962, paragraph Nos. [0005] to [0026]. These patent publications and application are hereby incorporated by reference.

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 $\mu$m disclosed in Japanese Patent Application No. 4-265,962 which is hereby incorporated by reference and a matting agent having an average particle size of up to 1 $\mu$m).

A conductive layer having a surface resistance of up to $10^{12}$ Ω at 25° C. and 30% RH may be provided in the recording material of the invention. The conductive layer may be provided either on the image formation layer side of the support or on the backcoat layer side. A single conductive layer or two or more such layers may be provided. Further, the conductive layer may be prepared by adding a conductive material to a layer having other functions such as a surface protecting layer, a backcoat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2$, $Al_2O_3$, $In_2O_3$, $SiO_2$, MgO, BaO, $MoO_3$ and $V_2O_5$ and composite oxides thereof. Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$Ω.cm, or more preferably, up to $10^5$Ω.cm. These oxides are disclosed in Japanese Unexamined Patent Publications Nos. 56-143,431, 56-120,519 and 58-62,647 which are hereby incorporated by reference.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235 which is hereby incorporated by reference.

The conductive material used in the invention should preferably have a particle size of up to 10 $\mu$m, or more preferably, up to 2 μm with a view to ensuring stability after dispersion. In order to achieve the lowest possible light scattering, it is desirable to use conductive particles having a particles size of up to 0.5 μm. Use of such conductive particles permits maintenance of transparency of the support by providing a conductive layer.

When the conductive material is acicular-shaped or fibrous, the material should preferably have a length of up to 30 μm and a diameter of up to 2 μm. or more preferably, a length of up to 25 μm and a diameter of up to 0.5 μm, with a length/diameter ratio of at least 3.

Preferable conductive polymeric compounds applicable in the invention include polyvinylbenzenesulfonic salts, polyvinylbenziltrimethylammonium chloride, grade-4 polymers as disclosed in U.S. Pat. Nos. 4,108,802, 4,118,231, 4,126,467, and 4,137,217 which are hereby incorporated by reference, and polymer latexes as disclosed in U.S. Pat. No. 4,070,189, West German Unexamined Patent Publication No. 2,830,767, Japanese Unexamined Patent Publications Nos. 61-296,352 and 61-62,033.

Some concrete examples of the conductive polymeric compound of the invention are enumerated below. Conductive materials applicable in the invention are not however limited to those presented below. The composition of the following polymers is expressed in percentage of polymerization.

E-1

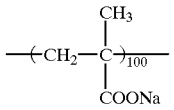

E-2

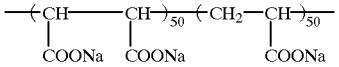

E-3

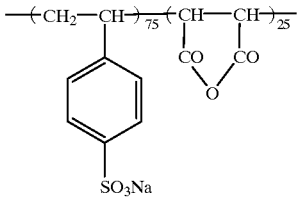

E-4

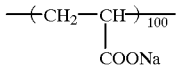

E-5

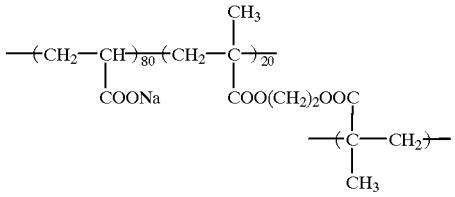

E-6

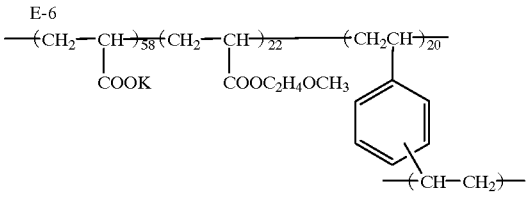

-continued

E-7

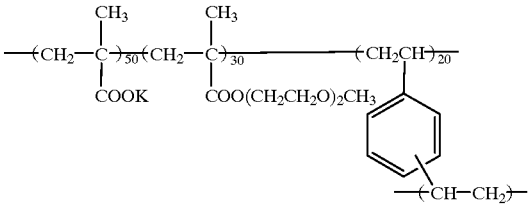

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatine and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatine (lime-treated gelatine, acid-treated gelatine, enzyme-decomposed gelatine, phthalized gelatine, acetylated gelatine, etc.), acetylcellulose, diacetylcellulose, triacetylcellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$ of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}\Omega$ under conditions including 25° C. and 30% RH, or more preferably, up to $10^{11}\Omega$.

A better antistatic property can be imparted by simultaneously using a fluorine-containing surfactant in addition to the foregoing conductive material. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No. 49-10,722, British Patent No. 1,330,356, U.S. Pat. Nos. 4,335,201, 4,347,308, B.P. No. 1,417,915, Japanese Unexamined Patent Publication No. 55-149,938, 58-196,544, and B.P. No. 1,439,402 which are hereby incorporated by reference.

Examples of the fluorine-containing surfactant applicable in the conductive layer are enumerated below.

F-1

$C_8F_{17}SO_3K$

F-2

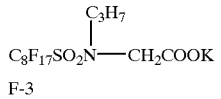

F-3

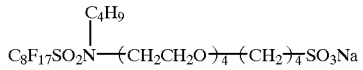

F-4

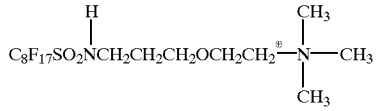

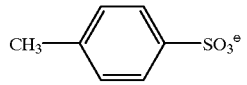

As the support in the recording material of the invention, any material may be used so far as it has a size stability and can withstand heat produced by laser irradiation, materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and poly(tetrafluoroethylene-co-hexafluoropropylene; polyethers such as polyoxymethylene; polyacetal; polyolefins such as plystyrene, polyethylene, polypropylene and methylpentenpolymer; and polyimides such as polyimide and polyetherimide. The thickness of the support, not particularly limited, should usually be within a range of from about 5 to about 200 $\mu$m. Transparent supports are preferably used in the present invention.

As required, a primer layer as disclosed in U.S. Pat. Nos. 4,695,288 and 4,737,486, which are hereby incorporated by reference, may be coated onto the support.

An image can be recorded on the recording material of the invention in accordance with an ordinary laser ablation recording method. In the present invention, laser irradiation is preferably accomplished from the image formation layer side since image forming based on the single sheet method is possible without the necessity of a receiving material.

The ablative recording material of the invention should have a Dmin of up to 0.11 after laser irradiation, as is described in Japanese Unexamined Patent Publication No. 8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 mW/$\mu$m$^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation).

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400 which is hereby incorporated by reference.

A laser ablative record with an image formed by laser irradiation onto the recording material of the invention should preferably be subjected to a treatment for increasing durability of the image. For example, a protecting layer may be formed on the surface of the image formation layer side for the protection of the image.

The protecting layer may be formed by the use of an image protecting laminated sheet disclosed in Japanese Unexamined Patent Publication Nos. 5-504,008 and 6-344,676, which are hereby incorporated by reference. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed fact to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676 which is hereby incorporated by reference, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676 which is hereby incorporated by reference. A siloxane-containing polymeric material can be prepared, for example, through copolymerization of an organic monomer or oligomer functionalized with a vinylether group and a siloxane monomer or oligomer. One prepared by any other method is also applicable. The protecting layer on the image has usually a thickness of up to 30 $\mu$m, and in order to prevent an excessive decrease in resolution, the thickness should preferably be up to 10 $\mu$m, or more preferably, within a range of from 0.5 to 6 $\mu$m.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image may be selected and formed on the recording material of the invention in response to the purpose of use, A person skilled in the art could the recording material support of the recording material and a material for the coloring agent for the recording material of the invention, depending upon a particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

A binder solution A used in this example is a 15% solution of nitric ester of carboxymethyl cellulose (acetone: 35%; water: 50%; pH adjusted to 6.6 by the use of ammonia water) having a degree of nitric ester group substitution of 2.1 and a degree of carboxymethylether group substitution of 0.7 per unit of glucose anhydride.

A binder solution B is a 15% solution of nitric ester of carboxymethyl cellulose (acetone: 40%; methanol: 20%; water: 25%; pH adjusted to 6.9 by the use of ammonia water) having a degree of nitric ester group substitution of 2.1 and a degree of carboxymethylether group substitution of 0.7 per unit of glucose anhydride.

A core-shell type vinylidene chloride copolymer, compounds A to E, surfactants 1 to 3, infrared-absorbing dye (a), yellow dye 1 and 2 and cyan dye 1 used in the present example represent the following compounds:

Core-shell type vinylidene chloride copolymer

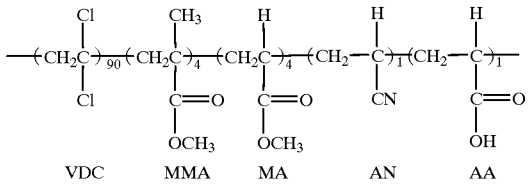

Core: VDC/MMA/MA (80 wt %)

Shell: VDC/AN/AA (20 wt %)

Average particle size: 70 nm

Compound A

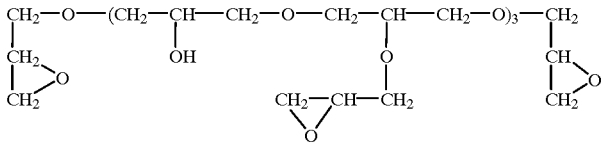

Compound B

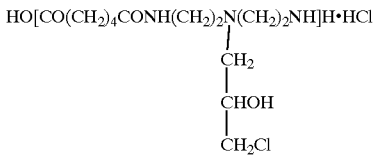

Compound C

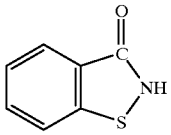

Compound D

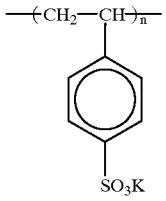

Compound E

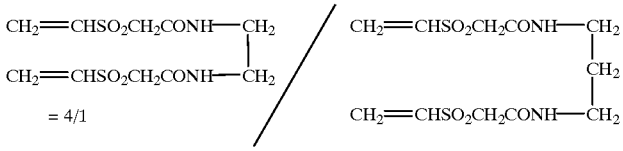

-continued

Surfactant 1

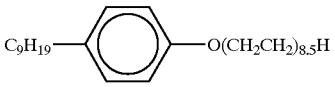

Surfactant 2

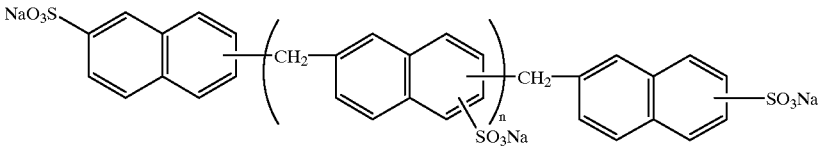

$n = 2 \sim 3$

Surfactant 3

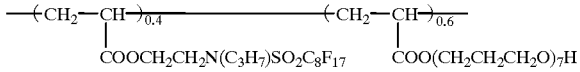

Infrared-absorbing dye (a)

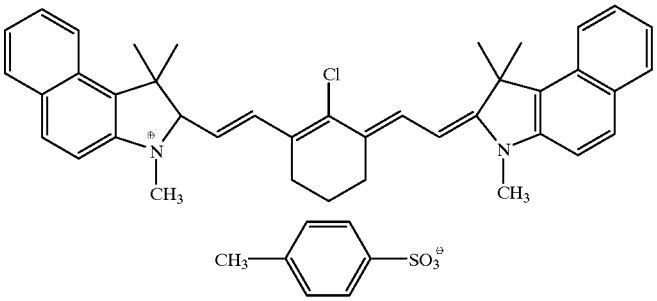

Yellow dye 1

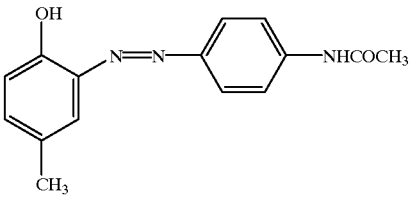

Yellow dye 2

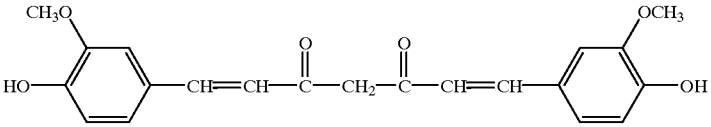

Cyan dye 1

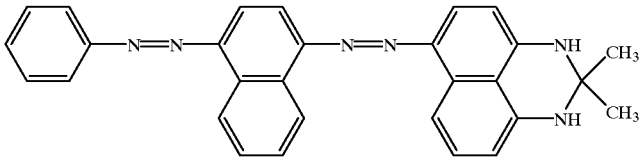

<Coating of Back Primer Layer>

The value of pH was adjusted to 6 by mixing the constituents of the first primer coating solution shown below and adding 10 wt. % KOH. The resultant first primer layer coating solution was two-dimensionally stretched out and coated onto one surface of a polyethylene terephthalate transparent support (thickness: 100 $\mu$m). The coated surface was then dried at 180° C. for two minutes to prepare a first primer layer having a dried thickness of 0.9 $\mu$m. A second primer layer coating solution having the following chemical composition was coated onto the first primer layer, and the coating was dried at 170° C. for two minutes to prepare a second primer layer having a dried thickness of 0.1 $\mu$m.

TABLE 1

Chemical composition of coating solution of first primer layer

| Constituent | Weight parts |
|---|---|
| Core-shell type vinylidene chloride copolymer | 15 |
| 2,4-dichloro-6-hydroxy-s-triazine | 0.25 |

TABLE 1-continued

| Chemical composition of coating solution of first primer layer | |
|---|---|
| Constituent | Weight parts |
| Polystyrene particulate (average particle size: 3 μm) | 0.05 |
| Compound A | 0.20 |
| Colloidal silica (Snowtex ZL; particle size: 70–100 μm; made by Nissan Kagaku Co.) | 0.12 |
| Water | Balance |
| (Total) | 100 |

TABLE 2

| Chemical composition of coating solution of second primer layer | |
|---|---|
| Constituent | Weight parts |
| Gelatine | 1 |
| Methyl cellulose | 0.05 |
| Compound B | 0.02 |
| $C_{12}H_{25}O(CH_2CH_2O)_{10}H$ | 0.03 |
| Compound C | $3.5 \times 10^{-3}$ |
| Acetic acid | 0.2 |
| Water | Balance |
| (Total) | 100 |

<Coating of Conductive Layer and Back Layer>

A conductive layer coating solution and a backcoat layer coating solution having the following chemical compositions were simultaneously coated on the second primer layer. Gelatine was coated in amounts of 0.06 g/m$^2$ and 0.5 g/m$^2{}_1$ respectively for the conductive layer and the backcoat layer. The thus prepared backcoat layer had a Beck smoothness of 400 seconds.

TABLE 3

| Chemical composition of coating solution of conductive layer | |
|---|---|
| Constituent | Weight parts |
| $SnO_2$/Sb (weight ratio: 9/1; average particle size: 0.25 μm) | 186 |
| Gelatine (Ca content: 3,000 ppm) | 60 |
| p-dodecylbenzene sodium sulfonate | 13 |
| Dihexyl-α-sodium sulfosuccinate | 12 |
| Compound D | 12 |
| Compound C | 1 |

TABLE 4

| Chemical composition of coating solution of back layer | |
|---|---|
| Constituent | Weight parts |
| Gelatine (Ca content: 30 ppm) | 0.5 |
| Polymethylmethacrylate particulate (average particle size: 4.7 μm) | 3 |
| Compound C | 0.8 |
| p-dodecylbenzene sodium sulfonate | 17.5 |
| Dihexyl-α-sodium sulfosccinate | 5.4 |
| $C_8H_{17}SO_3Li$ | 1 |

TABLE 4-continued

| Chemical composition of coating solution of back layer | |
|---|---|
| Constituent | Weight parts |
| N-perfluorooctanesulfonyl-N-propylglycinepotadium | 1.5 |
| Sodium sulfate | 45.6 |
| Sodium acetate | 10.3 |
| Compound E (film hardening agent) | Amount giving a water swelling ratio of 90% |

<Coating of Intermediate Layers>

Any one of intermediate layer coating solutions having the following chemical compositions was coated onto the surface of the support opposite to the back layer.

For an intermediate layers 1 and 2, the solution was coated in a coating amount of polyvinylbutyral of 0.25 g/m$^2$; for intermediate layers 3, 4 and 5, the solution was coated in a coating amount of cellulose nitrate of 0.25 g/ml$^2$; and for an intermediate layers 6 and 7, the solution was coated in a coating amount of cellulose nitrate of 0.20 g/m$^2$.

TABLE 5

| Chemical composition of coating solution of intermediate layer | | |
|---|---|---|
| Intermediate layer | Constituent | Weight parts |
| 1 | Polyvinyl butyral (Butvar B76; made by Monsant Co.) | 0.25 |
| 2 | Polyvinyl butyral (Butvar B76; made by Monsant Co.) | 0.25 |
| | Dye (2) | 0.13 |
| 3 | Cellulose nitrate (RS: 1/2 sec.; made by Daiseru Kagaku Kogyo Co.) | 0.25 |
| 4 | Cellulose nitrate (RS: 1/2 sec.; made by Daiseru Kagaku Kogyo Co.) | 0.25 |
| | Dye (2) | 0.13 |
| 5 | Cellulose nitrate (RS: 1/2 sec.; made by Daiseru Kagaku Kogyo Co.) | 0.25 |
| | Infrared-absorbing dye (a) | 0.13 |
| 6 | Cellulose nitrate (RS: 1/2 sec.; made by Daiseru Kagaku Kogyo Co.) | 0.20 |
| | Diacetyl cellulose | 0.05 |
| 7 | Cellulose nitrate (RS: 1/2 sec.; made by Daiseru Kagaku Kogyo Co.) | 0.20 |
| | Diacetyl cellulose | 0.05 |
| | Dye 2 | 0.13 |

<Coating of Image Formation Layer>

Any one of image formation layer coating solutions prepared by uniformly dispersing individual mixtures of the following chemical compositions was coated onto the intermediate layer in a coating amount of carbon black or colloidal silver 0.50 g/m$^2$.

TABLE 6

| Chemical composition of coating solution of image formation layer | | |
|---|---|---|
| Coloring agent layer | Constituent | Weight parts |
| 1 | carbon black (primary particle size: 80 nm) | 0.50 |

TABLE 6-continued

| Coloring agent layer | Chemical composition of coating solution of image formation layer: Constituent | Weight parts |
|---|---|---|
| | Polyvinyl alcohol (PVA-405; made by Kuraray Co.) | 0.67 |
| | Surfactant 2 | 0.03 |
| 2 | carbon black (primary particle size: 80 nm) | 0.50 |
| | Polyvinyl alcohol (PVA-405; made by Kuraray Co.) | 0.67 |
| | Dye (2) | 0.13 |
| | Surfactant 2 | 0.03 |
| 3 | Colloidal silver (particle size: 20 nm) | 0.50 |
| | Gelatine | 0.67 |
| | Surfactant 2 | 0.03 |
| 4 | Colloidal silver (particle size: 20 nm) | 0.50 |
| | Gelatine | 0.67 |
| | Dye (2) | 0.13 |
| | Surfactant 2 | 0.03 |

<Coating of Overcoat Layer>

Any one of overcoat layer coating solutions having the following chemical compositions was coated onto the image formation layer.

For an overcoat layer 1, the solution was coated in a coating amount of polyvinyl alcohol of 0.5 g/m$^2$; for an overcoat layer 2, the solution was coated in a coating amount of polyethyl metacrylate of 0.25 g/m$^2$.

TABLE 7

| Overcoat Layer | Chemical composition of coating solution of overcoat layer: Contents | Weight parts |
|---|---|---|
| 1 | Polyvinyl alcohol (PVA-405; made by Kuraray Co.) | 0.50 |
| | Surfactant 2 | 0.02 |
| 2 | Polyetyl metacrylate | 0.25 |
| | Polytetrafluoroethylene beads (Zonyl TLP-10F-1; made by Dupont, particle size: 0.2 $\mu$m) | 0.05 |
| | Nonylphenoxypolyglycidol | 0.005 |
| | Surfactant (Zonyl FSN-100, made by Dupont) | 0.01 |

Combination of the intermediate layer, the image formation layer and the overcoat layer for the individual samples are as shown in Table 8.

<Exposure Conditions for Image Recording>

Each sample was fixed, with the image formation layer side directed outside, to a drum of an image exposure apparatus similar to that disclosed in Japanese Unexamined Patent Publication No. 8-48,053. By the use of a diode laser (SDL-2430; wavelength range: 800 to 830 nm; made by Spectra Diode Labs.) and a lens mounted on a travelling stage of the apparatus, the focus of the laser was aligned with the sample surface (spot size: 10 $\mu$m; half-value width: 7 $\mu$m; focal output: 100 mW). The amount of irradiation on the sample surface was set at 500 mJ/cm$^2$ by adjusting the drum revolutions of the image exposure apparatus. the diode laser mounted on the travelling stage was caused to travel at a speed leading to a center distance of the irradiated beams of 7 $\mu$m.

Inorganic particulate such as carbon black and colloidal silver, and binder ablated by the laser was efficiently removed from the sample surface by blowing an air flow during laser irradiation by the use of an apparatus similar to that disclosed in Japanese Unexamined Patent Publication No. 8-72,400.

<Evaluation of Dmax and Dmin in UV Region>

Concentration at the laser-non-irradiated portion and the irradiated portion was measured by means of a densitometer using a UV filter (TD904; made by Macbeth Co.), and the respective measured values were recorded as Dmax (maximum concentration) and Dmin (minimum concentration) in the UV region. The results are as shown in the table below.

TABLE 8

| Sample No. | Test results: Intermediate layer No. | Image Formation layer No. | Overcoat layer No. | Dmax | Dmin |
|---|---|---|---|---|---|
| 1 | 1 | 1 | 1 | 4.2 | 0.45 |
| 2 (present inv.) | 2 | 1 | 1 | 4.3 | 0.17 |
| 3 | 3 | 1 | 1 | 4.2 | 0.25 |
| 4 (present inv.) | 4 | 1 | 1 | 4.3 | 0.09 |
| 5 | 5 | 1 | 1 | 4.2 | 0.20 |
| 6 | 6 | 1 | 1 | 4.2 | 0.31 |
| 7 (present inv.) | 7 | 1 | 1 | 4.2 | 0.14 |
| 8 (present inv.) | 6 | 2 | 1 | 4.3 | 0.15 |
| 9 (present inv.) | 7 | 2 | 1 | 4.3 | 0.11 |
| 10 | 6 | 3 | 1 | 3.5 | 0.56 |
| 11 (present inv.) | 7 | 3 | 1 | 3.5 | 0.15 |
| 12 (present inv.) | 7 | 4 | 1 | 3.6 | 0.13 |
| 13 (present inv.) | 7 | 1 | 2 | 4.2 | 0.16 |
| 14 (present inv.) | 7 | 4 | 2 | 3.6 | 0.15 |

As is clear from Table 8, use of the dihydroperimidinesquarilium represented by the general formula (1) of the invention is excellent in reducing Dmin as compared with the use of a known infrared absorbing dye (a). It is also indicated that the use of cellulose nitrate for the intermediate layer is excellent in terms of Dmin. These findings clearly shows the effectiveness of the present invention. In the Samples 13 and 14 using an overcoat layer 2, matting effect of the image is remarkable as compared with the other samples, and the image was easily readable with a slight traces of fingerprints.

Example 2

<Coating of Backcoat Layer>

A first backcoat layer (conductive layer), a second backcoat layer and a third backcoat layer (slip layer) were coated onto one surface of a polyethylene terephthalate support (thickness: 100 $\mu$m) which had previously been subjected to biaxial elongation and two-surface glow discharge treatment.

A conductive fine particle dispersion solution used for the first backcoat layer was prepared as follows. First, 230 g hydrated stannic chloride and 23 g antimony trichloride were dissolved in 3,000 g ethanol to obtain a uniform solution. To this solution, 1N sodium hydroxide aqueous solution was dropped to adjust pH to 3, thereby forming a co-precipitate of colloidal stannic oxide and antimony oxide. The resultant co-precipitate was held at 50° C. for 24 hours and a red-brown colloidal precipitate was centrifugally separated. Water was added to the thus separated red-brown colloidal precipitate for centrifugal separation, and this rinsing step was repeated three times, thereby removing excess ions. Subsequently, 200 g colloidal precipitate were dispersed again in 1,500 g water and the resultant dispersion solution was sprayed onto a baking oven heated to 500° C., thereby obtaining bluish fine particles of stannic oxide-antimony oxide composite mixture having an average particle size of 0.005 μm. The fine particle powder thus obtained had a resistivity of 25Ω.cm. A mixed solution of 40 g this fine powder and 60 g water was adjusted to pH 7.0, and roughly dispersed by means of a stirrer. Then, the solution was dispersed in a horizontal type sand mill (Dynomill, made by Willy A. Backfen AG.) for a retention time of 30 minutes, thus preparing a conductive fine particle dispersed solution in which partially aggregated primary particles formed a secondary aggregate of 0.05 μm.

A first backcoat layer coating solution having the chemical composition as shown in Table 9 was coated into a thickness in dry of 0.3 μm, and dried at 110° C. for 30 seconds. Then, a second backcoat layer coating solution having the chemical composition as shown in Table 9 was coated into a thickness in dry of 1.2 μm, and dried at 110° C. Further, a third backcoat layer coating solution prepared by heating, melting and adding a first solution to a second solution and dispersing the same by means of a high-pressure homogenizer was coated onto the second backcoat layer in an amount of 10 ml/m$^2$ and dried.

TABLE 9

| Chemical composition of backcoat layer coating solution | |
|---|---|
| Constituent | Weight parts |
| First backcoat layer | |
| Dispersed solution of conductive particles ($SnO_2/Sb_2O_2$, 0.15 μm) | 100 |
| Gelatine (calcified gelatine containing 100 ppm Ca) | 10 |
| Water | 270 |
| Methanol | 600 |
| Resorcin | 20 |
| Poly oxyethyleneonylphenylether (degree of polymerization: 10) | 0.1 |
| Second backcoat layer | |
| Diacetyl cellulose | 100 |
| Trimethylolpropane-3-toluenediisocyanate | 25 |
| Methylethyl ketone | 1050 |
| Cyclohexanone | 1050 |
| Third backcoat layer | |
| (First solution) | |
| Slip agent: $C_6H_{13}CH(OH)(CH_2)_{10}COOC_{40}H_{61}$ | 0.7 |
| Slip agent: n-$C_{17}H_{35}COOC_{40}H_{81}$-n | 0.1 |
| Xylene | 2.5 |
| (Second solution) | |
| Propyleneglycolmonomethylether | 34.0 |
| Diacetyl cellulose | 3.0 |
| Acetone | 600.0 |
| Cyclohexanone | 350.0 |
| Silica mat agent (average particle size: 3.5 μm) | 3.0 |

<Coating of Intermediate Layer>

Any one of the intermediate layers 1 and 2 of the Example 1 and intermediate layers 8 to 10 was coated onto the surface of the support opposite to the backcoat layer so as to achieve a nitric acid ester coating amount of carboxymethyl cellulose of 0.25 g/m$^2$.

TABLE 10

| Chemical composition of intermediate layer coating solution | | |
|---|---|---|
| Intermediate layer | Constituent | Weight parts |
| 8 | Binder solution A | 10.6 |
| | Acetone | 9.4 |
| | Water | 13.4 |
| 9 | Binder solution A | 10.6 |
| | Acetone | 9.4 |
| | Water | 13.4 |
| | Dye (2) | 0.32 |
| 10 | Binder solution A | 10.6 |
| | Acetone | 9.4 |
| | Water | 13.4 |
| | Infrared absorbing dye (a) | 0.32 |

Coating of Image Forming Layer>

Any one of the image forming layers 5 to 8 shown in the following table was coated onto the intermediate layer to achieve a coating amount of carbon black of 0.5 g/m$^2$. The individual image forming layer coating solutions were prepared by uniformly dispersed mixtures by means of a paint

TABLE 11

| Chemical composition of image forming layer coating solution | | |
|---|---|---|
| Image forming layer | Constituent | Weight parts |
| 5 | Cellulose nitrate (RS: 1/8 sec., Daiseru Kagaku Co.) | 5 |
| | Isopropyl alcohol | 2.14 |
| | Methylisobutyl ketone | 26.6 |
| | Methylethyl ketone | 62.0 |
| | SORSPERSE S20000 (Zeneka Co.) | 1.35 |
| | SORSPERSE S12000 (Zeneka Co.) | 0.23 |
| | Carbon black (primary particle size: 24 nm) | 5 |
| 6 | Cellulose nitrate (RS: 1/8 sec., Daiseru Kagaku Co.) | 5 |
| | Isopropyl alcohol | 2.14 |
| | Methylisobutyl ketone | 26.6 |
| | Methylethyl ketone | 62.0 |
| | SORSPERSE S20000 (Zeneka Co.) | 1.35 |
| | SORSPERSE S12000 (Zeneka Co.) | 0.23 |
| | Carbon black (primary particle size: 24 nm) | 5 |
| | Dye (2) | 1.3 |
| 7 | Yellow dye 1 | 0.6 |
| | Yellow dye 2 | 0.13 |
| | Cyan dye 1 | 0.23 |
| | Dye (2) | 0.23 |
| | Cellulose nitrate (RS: 1000 sec., Daiseru Kagaku Co.) | 0.6 |
| 8 | Yellow dye 1 | 0.6 |
| | Yellow dye 2 | 0.13 |
| | Cyan dye 1 | 0.23 |
| | Infrared absorbing dye (a) | 0.23 |
| | Cellulose nitrate (RS: 1000 sec., Daiseru Kagaku Co.) | 0.6 |

<Coating of Overcoat Layer>

The overcoat layer 1 or the overcoat layer 3 (prepared by changing the amount of beads coating of polytetrafluoroethylene for the overcoat layer 2 to 0.1 g/m$^2$) of the Example 1 was coated onto the foregoing image forming layer, thereby preparing samples 15 to 25.

Combinations of the intermediate layer, the image forming layer and the overcoat layer are as shown in Table 12.

<Evaluation of Dmax and Dmin in UV-region>

Laser exposure was carried out under the same conditions as in the Example 1 to evaluate Dmax (maximum concentration) and Dmin (minimum concentration) in the UV-region.

TABLE 12

| Test result | | | | | |
|---|---|---|---|---|---|
| Sample No. | Intermediate layer No. | Image forming layer No. | Overcoat layer No. | Dmax | Dmin |
| 15 | 1 | 5 | 1 | 3.9 | 0.31 |
| 16 (Invention) | 2 | 5 | 1 | 4.0 | 0.15 |
| 17 | 8 | 5 | 1 | 3.9 | 0.19 |
| 18 (Invention) | 9 | 5 | 1 | 4.0 | 0.07 |
| 19 | 10 | 5 | 1 | 3.9 | 0.14 |
| 20 (Invention) | 8 | 6 | 1 | 4.0 | 0.13 |
| 21 (Invention) | 9 | 6 | 1 | 4.0 | 0.05 |
| 22 (Invention) | 1 | 7 | 1 | 3.5 | 0.12 |
| 23 | 1 | 8 | 1 | 3.5 | 0.17 |
| 24 (Invention) | 9 | 5 | 3 | 3.9 | 0.09 |
| 25 (Invention) | 9 | 7 | 3 | 3.5 | 0.07 |

Table 12 indicates that, even when the image forming layer is a dye layer containing image dye dispersed in a polymer binder, Dmin can be reduced by using a dihydroperimidine-squarilium represented by the general formula (1) of the invention, and that further more excellent Dmin is available by using nitric acid ester of carboxyalkyl cellulose for the intermediate layer. Usefulness of the present invention is clear from the above description.

As compared with the other samples, the samples 24 and 25 using the overcoat layer 3 had a more remarkable matting effect of the image and gave a legible image with hardly discernible traces of fingerprints.

<Optical Resistance Test and Humidity/heat Resistance Test>

The samples 22 and 23 were held under a white fluorescent lamp (800 lux) for four and eight hours, and then absorption spectrum of the samples was measured by means of a spectrophotometer (Model U-3210 made by Hitachi Limited). Dye residual rate of each infrared absorption dye was determined from changes in absorbance of main absorption (about 830 nm) of the infrared absorption dye before and after light irradiation to evaluate optical resistance.

The samples 22 and 23 were held under an environment of 60° C. and 70% RH for three days, and then the dye residual rate of each infrared dye was determined in the same manner as in the optical resistance test to test humidity/heat resistance.

The results are shown in the following table.

TABLE 13

| Optical resistance and humidity/heat resistance test esults (dye residual rate in %) | | | |
|---|---|---|---|
| | Optical resistance test | | Humidity/heat resistance test |
| Sample No. | 4 hr. after | 8 hr. after | 3 days after |
| 22 (Invention) | 97 | 90 | 91 |
| 23 | 85 | 66 | 51 |

These results indicate that the dihydroperimidinesquarilium dyes represented by the general formula (1) of the invention have higher optical resistance and humidity/heat resistance than the known infrared absorbing dye (a).

Example 3

In Table 12 of Example 2, intermediate layer 11 shown in the following Table was used in place of Intermediate layers 1, 8 and 10 and intermediate layer 12 shown in the following Table was used in place of intermediate layers 2 and 9 to prepare samples. The coating solutions for intermediate layers 11 and 12 were coated in a coating amount of nitric ester of carboxymethyl cellulose of 0.25 g/m$^2$.

Laser exposure was carried out under the same conditions as in the Example 1 to evaluate Dmax (maximum concentration) and Dmin (minimum concentration) in the UV-region to confirm the same tendency as in Table 12.

TABLE 14

| Chemical composition of coating solution of intermediate layer | | |
|---|---|---|
| Intermediate layer | Constituent | Weight parts |
| 11 | Binder solution B | 11.3 |
| | Acetone | 8.8 |
| | Methanol | 4.4 |
| | Water | 5.5 |
| 12 | Binder solution B | 11.3 |
| | Acetone | 8.8 |
| | Methanol | 4.4 |
| | Water | 5.5 |
| | Dye (2) | 0.034 |

Example 4

Coating solutions for image forming layers 9 and 10 were prepared by adding 0.0373 weight parts of Surfactant 3 as a fluorine-containing surfactant to the coating solutions for image forming layers 5 and 6, respectively. In Table 12 of Example 2, image forming layers 9 and 10 were used in place of image forming layers 5 and 6 to prepare samples.

Laser exposure was carried out under the same conditions as in the Example 1 to evaluate Dmax (maximum concentration) and Dmin (minimum concentration) in the UV-region to confirm the same tendency as in Table 12.

Example 5

In Table 12 of Example 2, overcoat layer 4 shown in the following Table was used in place of overcoat layers 1 and 3 to prepare samples.

Laser exposure was carried out under the same conditions as in the Example 1 to evaluate Dmax (maximum concentration) and Dmin (minimum concentration) in the UV-region to confirm the same tendency as in Table 12.

TABLE 15

| Chemical composition of coating solution of overcoat layer | | |
|---|---|---|
| Overcoat Layer | Contents | Weight parts |
| 4 | Polyethyl metacrylate | 0.25 |
| | Polytetrafluoroethylene beads (Zonyl TLP-10F-1; made by Dupont, particle size: 0.2 μm) | 0.1 |
| | Florene TG710 (made by Kyoeisya Kagaku) | 0.03 |

Example 6

In Table 12 of Example 2, intermediate layer 11 was used in place of intermediate layers 1,8 and 10, intermediate layer 12 was used in place of intermediate layers 2 and 9, image forming layer 9 was used in place of image forming layer 5, image forming layer 10 was used in place of image forming layer 6 and overcoat layer 4 was used in place of overcoat layers 1 and 3 to prepare samples.

Laser exposure was carried out under the same conditions as in the Example 1 to evaluate Dmax (maximum concentration) and Dmin (minimum concentration) in the UV-region to confirm the same tendency as in Table 12.

What is claimed is:

1. A laser ablative recording material having no image receiving layer, said material having one or more image forming layers on a support, and one or more intermediate layers between said image forming layer and said support, wherein:

at least one layer from among the layers on the image forming layer side contains a substance having absorption in the laser wavelengths, which is selected from dihydroperimidine-squarilium dyes represented by the following general formula (1):

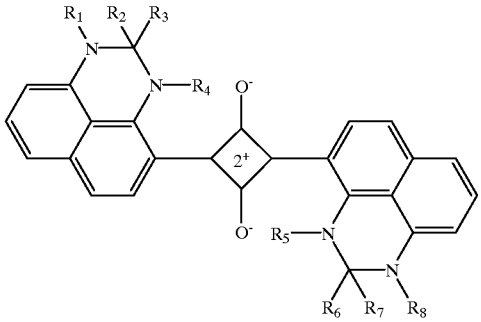

wherein $R_1$, $R_2$, $R_3$, $R_4$, $R_5$, $R_6$, $R_7$, and $R_8$ independently represent a hydrogen atom, a substituted or unsubstituted alkyl group, a substituted or unsubstituted cycloalkyl group, or a substituted or unsubstituted aryl group; and $R_1$ and $R_2$, $R_3$ and $R_4$, $R_5$ and $R_6$, $R_7$ and $R_8$, $R_2$ and $R_3$ and/or $R_6$ and $R_7$ may be taken together to form one or more 5 to 6 membered rings, said laser ablative recording material having a backcoat layer on the surface of the support opposite to the image forming layer, the outermost surface of said backcoat layer having a Beck smoothness of up to 4,000 seconds.

2. A laser ablation recording material according to claim 1, wherein $R_1$, $R_4$, $R_5$ and $R_8$ in the general formula (1) are hydrogen atoms.

3. A laser ablative recording material according to claim 1, wherein $R_2$=$R_6$ and $R_3$=$R_7$ in the general formula (1).

4. A laser ablative recording material according to claim 1, wherein $R_2$, $R_3$, $R_6$ and $R_7$ in the general formula (1) are substituted or unsubstituted alkyl group or substituted or unsubstituted aryl group.

5. A laser ablative recording material according to claim 4, wherein $R_2$, $R_3$, $R_6$ and $R_7$ in the general formula (1) are substituted or unsubstituted alkyl groups.

6. A laser ablative recording material according to claim 1, wherein $R_2$ and $R_3$, and $R_6$ and $R_7$ in the general formula (1) are taken together to form 5 or 6 membered ring.

7. A laser ablative recording material according to claim 1, wherein the dihydroperimidinesquarilium dye has a symmetric structure.

8. A laser ablative recording material according to claim 1, wherein said substance having absorption in the laser wavelengths is contained in said intermediate layer.

9. A laser ablative recording material according to claim 1, wherein said image forming layer contains inorganic fine particles as an image forming substance.

10. A laser ablative recording material according to claim 9, wherein said inorganic fine particles are carbon black and/or colloidal silver.

11. A laser ablative recording material according to claim 1, which has an overcoat layer on said image forming layer.

12. A laser ablative recording material according to claim 11, wherein said overcoat layer contains polytetrafluoroethylene beads, but does not contain inorganic fine particles as an image forming substance.

13. A laser ablative recording material according to claim 1, wherein said substance having absorption in the laser wavelengths is contained solely in said image forming layer.

14. A laser ablative recording material according to claim 13, wherein said image forming layer comprises a dye layer containing an image dye dispersed in a polymer binder, and said image dye having absorption in an electromagnetic spectral region of from 300 to 700 nm does not substantially have absorption in the laser wavelengths used for exposing said recording material.

15. A laser ablative recording material according to claim 1, wherein cellulose nitrate is contained in said intermediate layer.

16. A laser ablative recording material according to claim 1, wherein a nitric acid ester of carboxyalkyl cellulose is contained in said intermediate layer.

17. A laser ablative image-formed record prepared by irradiating a laser onto the laser ablative recording material according to claim 1.

18. A laser ablative image-formed record according to claim 17, prepared by providing a withstanding layer on the surface on the image forming layer side after laser irradiation.

* * * * *